US005579700A

United States Patent [19]

Nuechterlein et al.

[11] Patent Number: 5,579,700

[45] Date of Patent: Dec. 3, 1996

[54] INTERLOCKING SPILL PALLET SYSTEM

[75] Inventors: David J. Nuechterlein, Shaker Heights; James P. Onders, Independence; Robert D. Heintz, Rock Creek; David G. DeBord, Aurora; Darel Taylor, Chardon, all of Ohio

[73] Assignee: ENPAC Corporation, Chardon, Ohio

[21] Appl. No.: 511,934

[22] Filed: Aug. 7, 1995

[51] Int. Cl.[6] ..... B65D 19/44

[52] U.S. Cl. ..... 108/55.1; 108/56.1; 108/54.1

[58] Field of Search ..... 108/51.1, 55.1, 108/56.1, 54.1

[56] References Cited

U.S. PATENT DOCUMENTS

| | | | |
|---|---|---|---|
| 3,650,224 | 3/1972 | Petix et al. | 108/51.1 |
| 4,095,769 | 6/1978 | Fengels | 108/54.1 X |
| 4,694,962 | 9/1987 | Taub | 108/54.1 X |
| 5,092,251 | 3/1992 | Hamaker et al. | 108/51.1 |
| 5,105,746 | 4/1992 | Reynolds | 108/51.1 X |
| 5,170,721 | 12/1992 | Troth et al. | 108/51.1 |
| 5,254,798 | 10/1993 | Zoback | 108/51.1 X |
| 5,307,931 | 5/1994 | Gillispie et al. | 108/51.1 X |
| 5,359,955 | 11/1994 | Grebenyuk | 108/51.1 |

*Primary Examiner*—Jose V. Chen

*Attorney, Agent, or Firm*—Pearne, Gordon, McCoy & Granger

[57] ABSTRACT

A spill pallet for supporting a plurality of fluid containing vessels. The pallet has a bottom and a series of vertically oriented side walls which cooperate to form an open-topped box structure. The side walls have a peripheral rim defining portion which includes an inwardly extending lip portion substantially parallel to the bottom wall. A plurality of pillar supports are provided between the bottom wall and the lip portion to support the lip portion. The bottom wall has a central support member defining an upper surface which is substantially co-planar with the lip portion. A grate is mounted on the central support member and has edges which are supported by the lip portion. Interlocking member are provided to attach pallets together and those interlocking members are also adapted to attach loading ramps to the pallet.

7 Claims, 6 Drawing Sheets

10
14
16
82
82

10
12
20
14
20
22
22
28
82
82
28

INTERLOCKING SPILL PALLET SYSTEM

BACKGROUND OF THE INVENTION

The present invention generally relates to pallets and, more particularly, to spill pallets which support liquid containing drums and are capable of retaining spilled or leaked liquid from such drums.

Spill pallets had been developed in accordance with guidelines of the United States Environmental Protection Agency (EPA) and are designed to support one or more drums to provide a reservoir to contain liquid should it escape or leak from the drums. The EPA requires that hazardous waste be stored in a containment system having a sufficient capacity to contain 10% of the volume of the containers or the volume of the largest container, whichever is greater.

A typical prior art spill pallet is disclosed in U.S. Pat. No. 5,359,955 which issued to Grebenyuk on Nov. 1, 1994. Such a spill pallet is intended to support four 55 gallon drums by having a bottom wall with a central support member extending upwardly therefrom and a series of support rails associated with a series of side walls. The central support member and the support rails provide a stable surface for one or more grates mounted thereon. Since the central support member occupies a portion of the space which would otherwise provide a containment chamber the height of the side walls must necessarily be increased to provide the required volumetric capacity of the spill pallet. It is important that the height of the spill pallet be as small as possible, since it is preferable to load drums onto the surface of the pallet by employing ramps and hand trucks rather than forklift trucks because of the possibility of puncturing adjacent drums by the forklift. However the length of the ramp incline increases proportional to the height of the pallet surface for safe hand truck operation. It is also desirable to increase the surface area of the spill pallet to gain additional volumetric capacity, but merely increasing the surface area of the prior art pallets greatly reduces the ability of the support rails to resist the additional loading.

It is also desirable to provide a pallet area in a work place having a drum supporting surface which permits the storage of a multiplicity of drums in close proximity. Prior art techniques for such a storage arrangement involve merely placing a plurality of pallets in close proximity to support the multiplicity of drums in a close packed arrangement. However since the pallets are not attached to each other, there exists the danger of one or more pallets to become shifted relative to a contiguous pallet to provide a gap or gaps between the pallets. Improper placement of a drum over such a gap will improperly load the side wall of a pallet. Furthermore merely placing a loading ramp in abutment with a side wall of a pallet will not necessarily ensure that the ramp will remain in place during the transport of a drum unto the grate surface of the pallet.

BRIEF DESCRIPTION OF THE INVENTION

This invention provides a spill pallet which has an increased surface area for supporting a greater number of drums than prior art pallets and which, therefor, has an increased capacity for containing spills. The spill pallet according to this invention is designed to provide increased stiffness along its support rails so that the length of the rails may be increase to thereby increase the support area of the pallet and to thereby lower the height of the pallet.

Each spill pallet according to this invention includes one or more sockets which cooperate with connector blocks so that adjacently placed pallets may be mechanically interlocked to minimize shifting of the pallets relative to each other. The sockets may also be employed to mechanically interlock with a spill ramp to effectively lock the spill ramp adjacent the pallet.

A pallet according to this invention has a bottom wall and a series of vertically oriented side walls. The bottom wall cooperates with the side walls to define an open-topped box structure. Each of the side walls has a peripheral rim defining portion which includes an outwardly extending lip portion substantially parallel to the bottom wall. A plurality of pillar supports between the bottom wall and the lip portion supports the lip portion and define a pocket in the side wall. Each pocket defines a socket which is adapted to cooperate with a projection on a connector block so that a pallet may be mechanically linked to an adjacent pallet. The socket is adapted to cooperate with a linking projection on a spill pallet positioned adjacent the rim of a pallet.

DETAILED DESCRIPTION OF THE INVENTION

Figure 9:
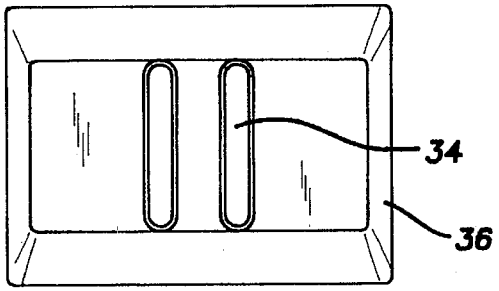
FIG. 9 is a plan view of the connector block.
Figure 10:
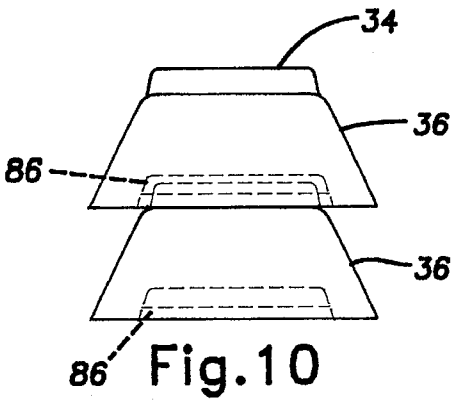
FIG. 10 is an elevational view of stacked connector blocks.

Referring now to the drawings and particularly to FIGS. 1 through 5 there is illustrated a spill pallet 10 according to this invention. The spill pallet 10 has a bottom wall 12 and a series of vertically oriented side walls 14. The bottom wall 12 cooperates with the side walls 14 to define and open-topped box structure. Each of the side walls 14 has a peripheral rim defining portion 16 which includes an inwardly extending lip portion 18 substantially parallel to the bottom wall 12. The bottom wall 12 forms a plurality of pillar supports 20 between the bottom wall 12 and the lip portion 18. Each pillar support 20 is defined by a pocket formed at the intersection of the bottom 12 and the side wall 14. Each pillar support 20 includes side support walls 22 extending between the bottom wall 12 and the lip portion 18. A front wall 24 joins the side support walls 22 and a top wall 26 (FIG. 7) is provided under the lip portion 18 joining the side support walls and the front wall. An upwardly extending socket 28 is defined by alternate ones of the top walls 26 on the sides and ends of the pallet. Each socket 28 is adapted to receive an upwardly extending projection 30 of a loading ramp 32 or an upwardly extending projection 34 of a connector block 36 (FIGS. 8 through 10).

Figure 1:
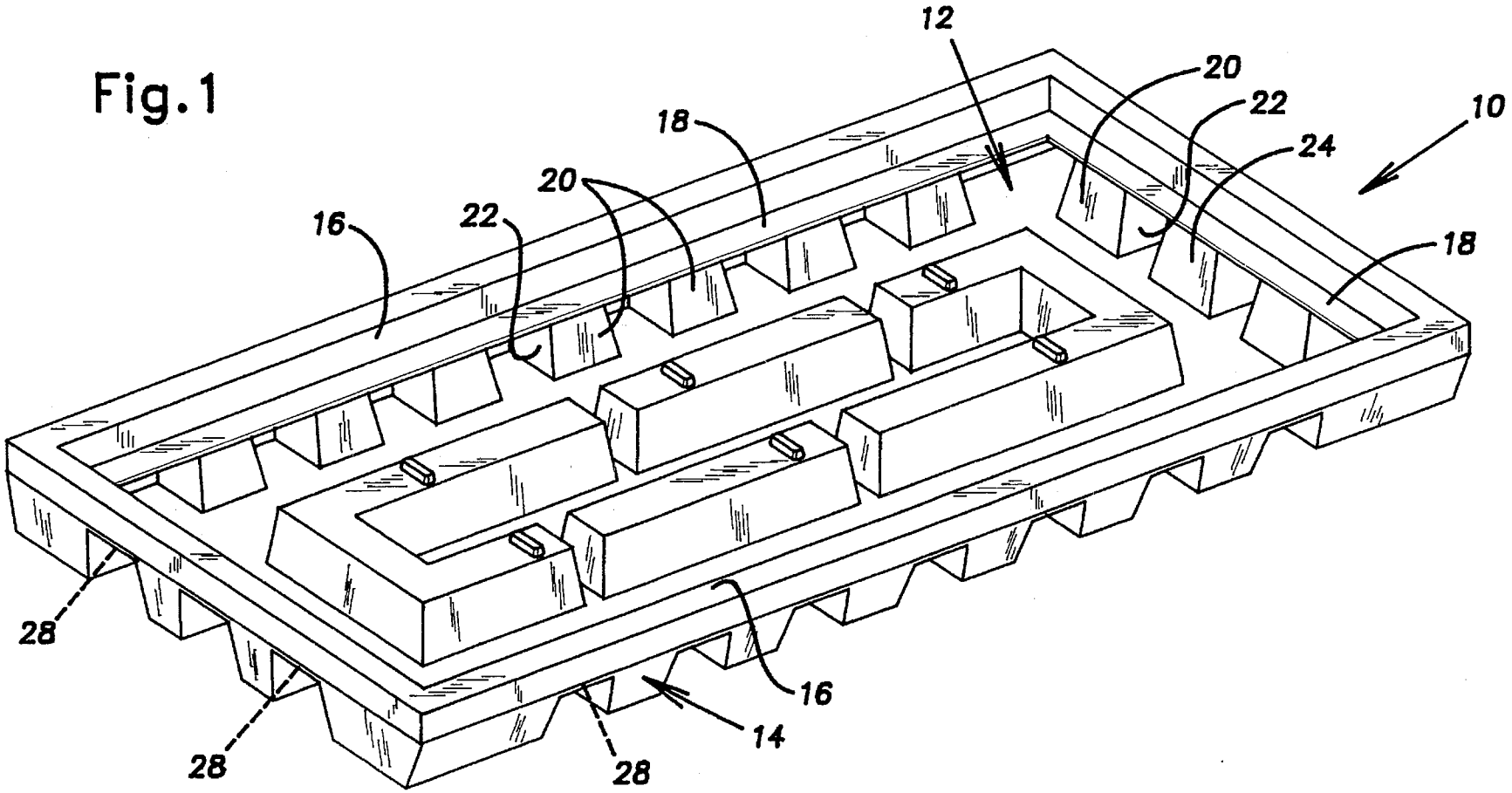
FIG. 1 is a perspective view of a pallet according to this invention showing the pallet with its grate removed for clarity.
Figure 3:
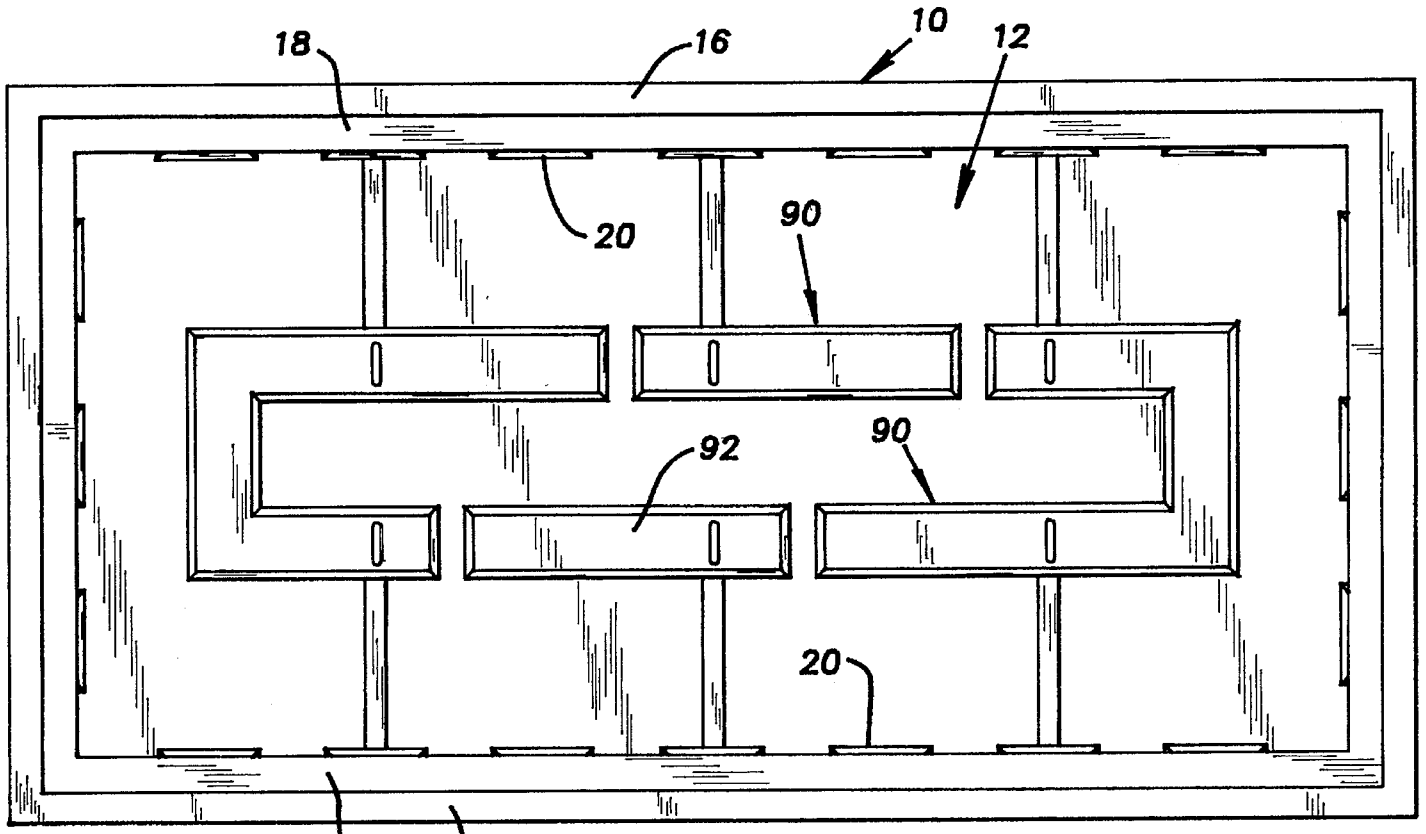
FIG. 3 is a plan view of the pallet.
Figure 2:
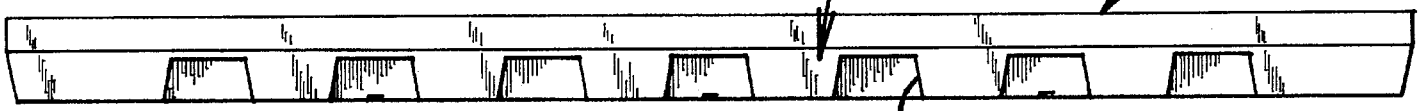
FIG. 2 is a side view of the pallet.
Figures 4, 5:
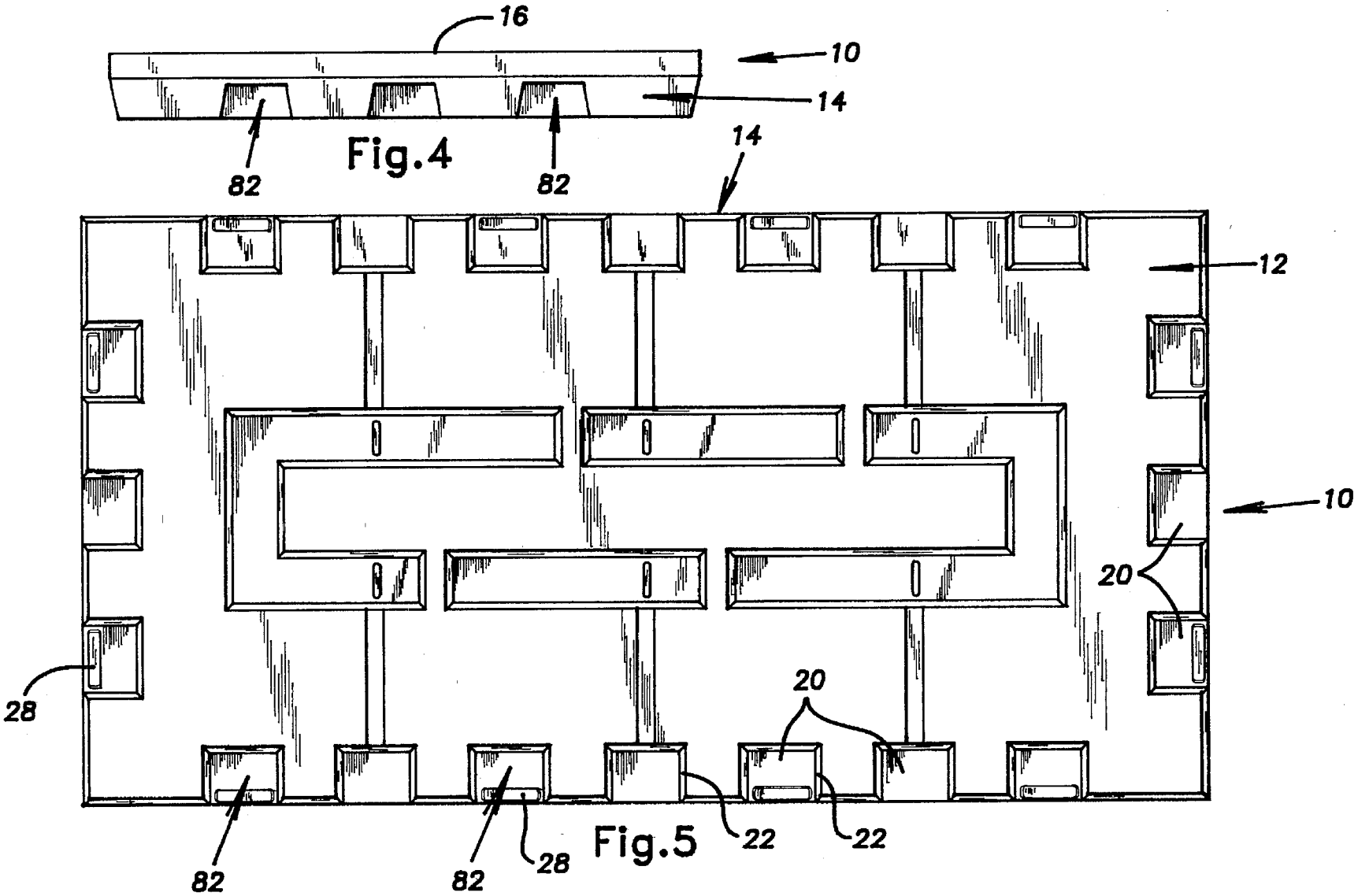
FIG. 4 is an end view of the pallet.
FIG. 5 is a bottom view of the pallet.
Figure 6:
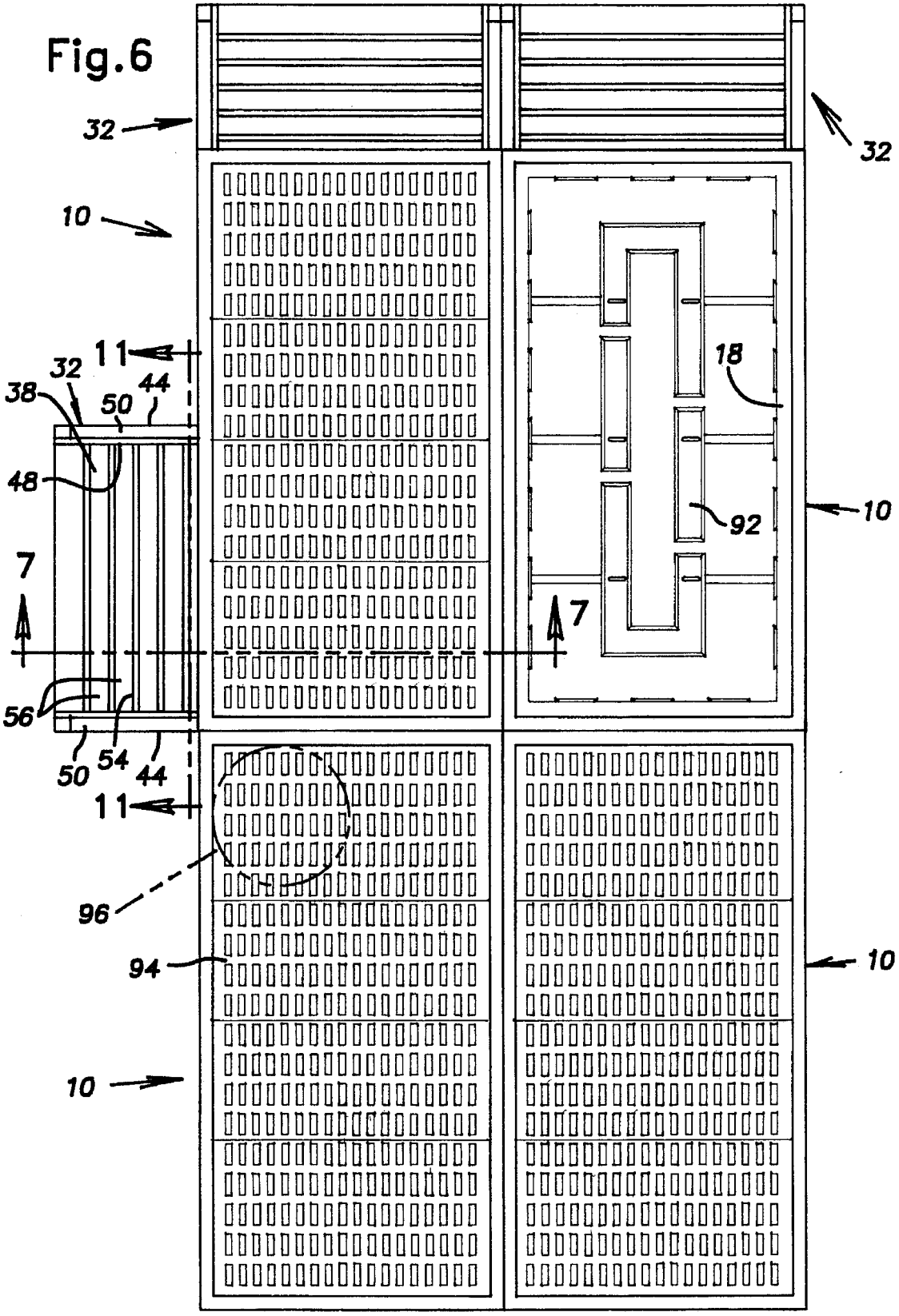
FIG. 6 is a plan view of a series of interlocked pallets provided with interlocked ramps.
Figure 7:
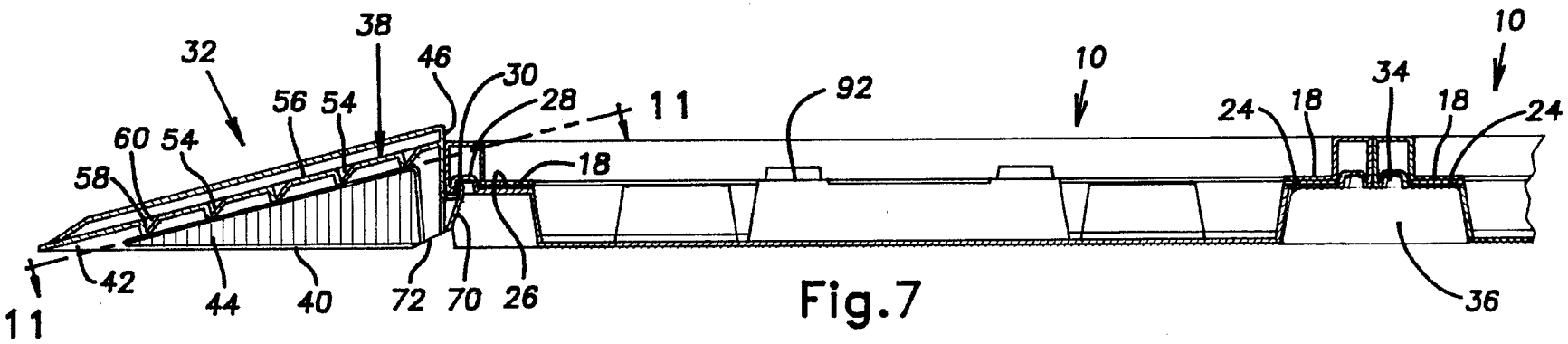
FIG. 7 is a cross-sectional view, the plain of the section being indicated by the line 7—7 in FIG. 6.
Figure 8:
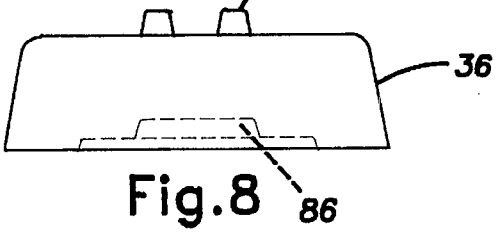
FIG. 8 is an elevational view of a connector block according to this invention.

As may be seen in FIGS. 6 and 7 the loading ramp 32 is wedge shaped and has an inclined upper load carrying wall 38. The ramp 32 further included a bottom wall 40 joining the load carrying wall 38 at one end 42 thereof and side walls 44 which extend from the end 42 to an end wall 46 which joins the side walls 44.

The load carrying wall 38 defines longitudinal gutters 48 to collect any spillage.

The lateral edges of the ramp comprise raised side rails 50 which prevent roll-off of carts or dollies transporting containers on the ramp. The rails 50 have outwardly extending flanges 52 so that the ramp may be easily grasped to transport the ramp from location to location so that the ramp or other ramps may be placed at various locations around a pallet as is illustrated in FIG. 6.

The upper surface of the wall 38 further defines a plurality of transverse valleys 54 which connect the longitudinal gutters 48 and, with the gutters 48, define a plurality of transverse, raised treads 56. Each valley 54 and, therefor, each tread 56 is defined by a first wall 58 perpendicular to the upper surface of a tread 56 and a second wall 60 sloping upwardly to an upper surface of an adjacent tread. This configuration of the transverse valleys provides a gripping surface for the wall 38 and provides lateral dispersions to the gutters of any spillage on the wall 38.

Figures 11, 12:
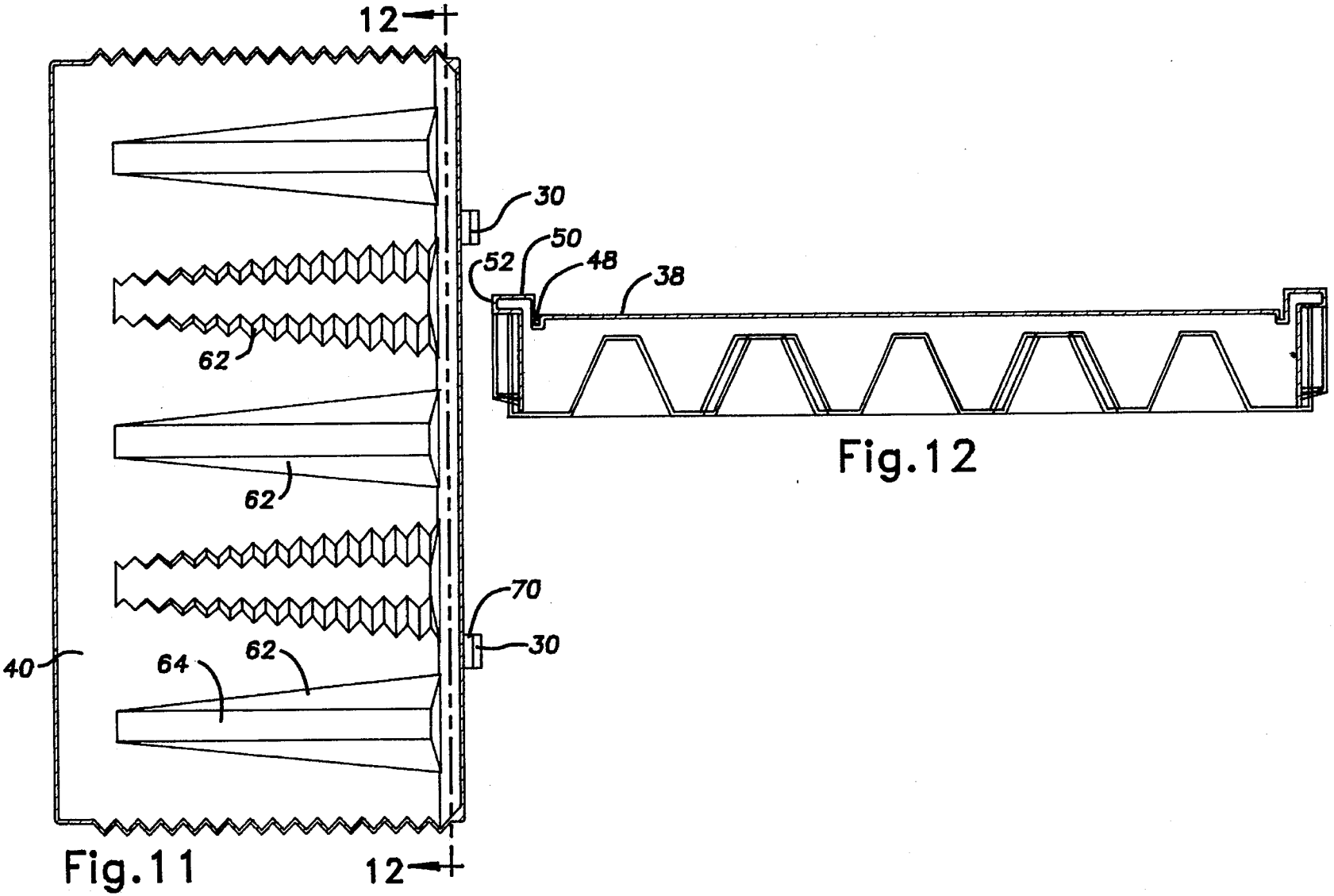
FIG. 11 is a cross-sectional view, the plane of the section being indicated by the line 11—11 in FIG. 7.
FIG. 12 is a cross-sectional view, the plane of the section being indicated by the line 12—12 in FIG. 11.

Referring now to FIG. 12, the bottom wall 40 defines a plurality of ribs 62 which extend upwardly from a ground engaging portion of the wall 42 to upper portions 64. The upper portions 64 are fused or bonded to the lower edge of the transfers valleys 54 to provide rigidity to the structure. The ribs 62 have side walls which taper upwardly toward the transverse valleys 54 and the side walls 62 taper from the end wall 46 toward the end 42 to provide lateral stability to the structure. Some or all of the walls 62 may be corrugated for stiffening purposes as shown.

To further stiffen the structure the side walls 44 are corrugated.

The projection 30 is associated with a linkage projection 70 on the wall 46 having a sloped end 72 which permits the ramp 32 to be tilted for insertion of the projection 30 into engagement with the socket 28.

It may be noted that the width of the ramp 32 is preferably ½ the length of a pallet 10 so that two ramps may be positioned side by side along the length of a pallet 10. It may be further noted that it is preferable that a pallet have a width which is ½ its length so that a single pallet may be attached to its end or two pallets may be linked along the length of a single pallet.

Referring now to FIGS. 8 through 10 the connector block 36 has sloping side walls 80 which are dimensioned to be received in a pocket 82 formed by the pillar supports 20. The connector block 36 is provided with a pair of parallel projections 34 which are received in the sockets 28 of adjacent pallets 10 to securely lock the pallets together. Each block 36 has a recess 86 in its bottom which accommodates the projection 34 of another connector block 36 as is shown in FIG. 10.

The bottom wall of each pallet defines a central support member 90 which comprises a discontinuous rectangle having a top wall 92 which is co-planar with the lip portion 18. Each pallet 10 is provided with four grates 94 which rest on the wall 92 and the lip 18 to support a plurality of drums 96. The grates 94 are separated by upstanding ridges 98 which project from the walls 92.

What is claimed is:

1. A pallet for supporting a plurality of fluid containing vessels, said pallet having a bottom wall and a series of vertically oriented side walls, said bottom wall cooperating with said side walls to define an open-topped box structure, each of said side walls having a peripheral rim defining portion which includes an inwardly extending lip portion substantially parallel to said bottom wall, a plurality of pillar supports between said bottom wall and said lip portion, each pillar support being defined by a pocket formed at a juncture of said bottom wall and said side wall which includes side support walls extending between said bottom wall and said lip portion, a front wall joining said side support walls and which includes a top wall beneath said lip portion joining said side support wall said front wall, said bottom wall having a central support member defining an upper surface which is substantially co-planar with said lip portion, and a grate mounted on said central support member and having edges supported by said lip portion.

2. A pallet assembly according to claim 1 wherein said vertically oriented side walls diverge outwardly from said bottom wall, said peripheral rim defining portion comprising a vertical extension of said side walls, a parallel wall extending upwardly from said lip portion and being joined to said vertical extension by a horizontal wall.

3. A pallet according to claim 2 wherein lateral shifting of said grate is resisted by said parallel wall.

4. A pallet according to claim 2 wherein said top wall of at least one of said pillar supports defines a socket projecting upwardly into a pocket defined by said vertical extension, said parallel wall and said horizontal wall.

5. A pallet according to claim 4, including a connector block having a first portion positioned within said pocket, said first portion of said connector block having a first upwardly extending projection received in said socket, a second portion of said connecting block projecting from said pocket and having a second upwardly extending projection adapted to cooperate with a socket of an adjacent pallet.

6. A pallet assembly according to claim 5 including a second pallet having one of its upwardly extending sockets receiving said second upwardly extending projection of said connecting block.

7. A pallet assembly according to claim 6, including a wedge shaped loading ramp for said pallet, said loading ramp having an end wall provided with a connector having an upwardly extending projection received in said socket to securely interlock said ramp with said pallet.

* * * * *

UNITED STATES PATENT AND TRADEMARK OFFICE

CERTIFICATE OF CORRECTION

PATENT NO. : 5,579,700

DATED : December 3, 1996

INVENTOR(S) : David J. Nuechterlein, et al.

It is certified that error appears in the above-indentified patent and that said Letters Patent is hereby corrected as shown below:

Claim 1, column 4, line 25, please insert --and-- after "said side support wall"

Signed and Sealed this

Twenty-fifth Day of March, 1997

*Attest:*

Bruce Lehman

BRUCE LEHMAN

*Attesting Officer*

*Commissioner of Patents and Trademarks*